US006581925B1

(12) United States Patent
Shea et al.

(10) Patent No.: US 6,581,925 B1
(45) Date of Patent: Jun. 24, 2003

(54) FEEDER AND RETARD ROLLERS, AND METHOD OF MAXIMIZING LIFETIME OF ROLLERS

(75) Inventors: Robert H Shea, Bloomfield, NY (US); Elji Sawa, Pittsford, NY (US); Stephen Powell, Rochester, NY (US)

(73) Assignee: Illbruck GmbH, Leverkusen (DE)

( * ) Notice: Subject to any disclaimer, the term of this patent is extended or adjusted under 35 U.S.C. 154(b) by 0 days.

(21) Appl. No.: 09/524,962

(22) Filed: Mar. 14, 2000

(51) Int. Cl.[7] ..... B65H 3/06
(52) U.S. Cl. ..... 271/125; 271/37; 271/124
(58) Field of Search ..... 271/37, 120, 121, 271/124, 125

(56) References Cited

U.S. PATENT DOCUMENTS

| | | | | |
|---|---|---|---|---|
| 4,019,730 A | * | 4/1977 | Staudinger et al. | 271/181 |
| 4,030,722 A | * | 6/1977 | Itvine et al. | 271/125 |
| 4,974,367 A | | 12/1990 | Sawluk | |
| 5,007,627 A | * | 4/1991 | Gianneti et al. | 271/34 |
| 5,049,943 A | | 9/1991 | Menjo et al. | |
| 5,056,604 A | * | 10/1991 | Garavuso | 271/18 |
| 5,116,034 A | * | 5/1992 | Trask et al. | 271/2 |
| 5,192,141 A | * | 3/1993 | Chung et al. | 271/119 |
| 5,209,464 A | | 5/1993 | Bermel et al. | |
| 5,271,615 A | * | 12/1993 | Kawauchi et al. | 271/121 |
| 5,294,102 A | | 3/1994 | Ifkovitz, Jr. et al. | |
| 5,333,848 A | * | 8/1994 | Rubscha | 271/117 |
| 5,435,540 A | * | 7/1995 | Martin et al. | 271/122 |
| 5,556,326 A | | 9/1996 | Rouyer et al. | |
| 5,651,542 A | * | 7/1997 | Yamauchi et al. | 271/122 |
| 5,664,771 A | * | 9/1997 | Nagatani et al. | 271/10.03 |
| 5,669,605 A | | 9/1997 | Sawa et al. | |
| 5,882,002 A | | 3/1999 | Kamei et al. | |
| 5,932,313 A | * | 8/1999 | Barton | 428/141 |
| 6,194,478 B1 | * | 2/2001 | Cox et al. | 271/109 |

FOREIGN PATENT DOCUMENTS

| | | |
|---|---|---|
| EP | 0 313 023 | 4/1989 |
| EP | 0840 179 A1 | 5/1998 |
| WO | 91/09352 | 6/1991 |

* cited by examiner

*Primary Examiner*—Christopher P. Ellis
*Assistant Examiner*—Mark A. Deuble
(74) *Attorney, Agent, or Firm*—Stephen B. Salai, Esq.; Roger Aceto, Esq.; Harter, Secrest & Emery LLP

(57) ABSTRACT

Sheet feed apparatus including a scuff feed for reliably transporting sheets from different types of sheet stacks and different types of sheets within the stack. The apparatus comprises a sheet feed roller and a retard device in contact with the feed roller. A nudging device, contacting a paper stack, is used to feed single or multiple sheets into the nip between the feed roller and retard device. The feed roller, retard device, and nudging device all have a surface layer of 35-28092-N-GY-A, which gives them a much longer useful lifetime. A method for maximizing the efficent use of these rollers and of testing and using these rollers is also disclosed.

9 Claims, 3 Drawing Sheets

FEEDER AND RETARD ROLLERS, AND METHOD OF MAXIMIZING LIFETIME OF ROLLERS

FIELD OF THE INVENTION

The present invention relates generally to sheet feeding apparatuses, and specifically to feed rollers and retard rollers with a wearable release outer layer and their use. It is further directed to a method testing these rollers and increasing the longevity of the rollers.

BACKGROUND OF THE INVENTION

The present invention relates generally to scuff feeds for transporting sheets from a sheet stack, and more particularly, to a scuff feed having an outer layer that does not retain contaminants and wears slowly.

In modern reproduction apparatuses, such as electrostatographic copiers or printers, a latent image of information to be reproduced is formed on a uniformly charged dielectric member, altering the charge in an image-wise pattern. The latent image charge pattern is then developed with pigmented marking particles. Thereafter, the developed image is transferred to a receiver member and fixed to the receiver member by application of heat and/or pressure to form the desired reproduction.

In order to improve the productivity of reproduction apparatuses, sheet-feeding systems for reproduction devices have been developed. Several processes are known for separating sheets of paper to be loaded. Common feeding processes consist of using a combination of rollers that feed sheets of paper into the reproduction apparatus.

Paper separating mechanisms that use a friction retard systems include at least one paper feed roller and one retard member, which may be either a fixedly secured pad or a retard roller. Many apparatuses use the latter.

The two rollers form a nip between them that allows single sheets of paper to pass through. The retard roller uses a resistance mechanism to cause the roller to rotate at a predetermined rate. This rate is set so that exactly one sheet passes through the nip at a time. In the conventional paper separating mechanisms mentioned above, both the feed roller and the retard roller are made of rubber or similar material in order that these rollers may have appropriate coefficients of friction (COFs) relative to paper The feed roller an the retard roller each comprise a core and an outer "tire." The tire is a hollow cylindrical tube surrounding the core. The tires are placed around shafts that rotate. Sometimes an adhesive is used to hold the tire in place. During the feeding process a tire that is not secured may not rotate with the shaft. This will lead to either a nonfeed or double feed situation.

One problem with current feed and retard rollers is the short useful lifespan of many of them. It is desirable to use tire materials that have a long lifetime and a resistance to surface contamination. Many materials will absorb oils or pick up contaminants that may be on the substrate being fed into the reproduction apparatus. The oil and contaminants may decrease the lifetime of the roller. Contamination also decreases the COF of the roller, increasing the chances of the device not properly feeding sheets into the copier.

A second problem with current rollers is that the outer layer of feed rollers and the retard rollers usually have to be made out of different materials. This is undesirable since it also means different wear rates and different amounts of surface contamination.

SUMMARY OF THE INVENTION

An object of the invention was to create a sheet feeding apparatus that uses at least one feed roller having a much longer lifetime than current rollers.

A second object of the invention was to create a sheet feeding apparatus that uses at least one feed roller that resists contamination better than current feed rollers.

A third object of this invention is to demonstrate the proper way to choose the COF, nip pressure, and retard roller braking force, to achieve a maximum lifetime in systems that use a feed roller and a retard roller.

The invention is a sheet feeding apparatus comprising a feed roller and a retard roller. The rollers have an outer layer that is a material that wears at a rate sufficient to drastically reduce the amount of contaminants that collect on the feed roller.

The reduction in contaminants reduces the loss of COF of the rollers. The new improved rollers operate for much longer periods without misfeeds. Experimental evidence has demonstrated lifetimes of up to four times that of previous surface materials.

The present invention also includes novel ways of testing the new rollers as traditional testing methods were deemed inadequate, especially with regard to the wear rate and COF of the rollers.

The present invention also shows a method of exploiting a relationship among the COF, the nip pressure, and the retard roller braking force.

DETAILED DESCRIPTION OF THE PREFERRED EMBODIMENT

Figure 1:
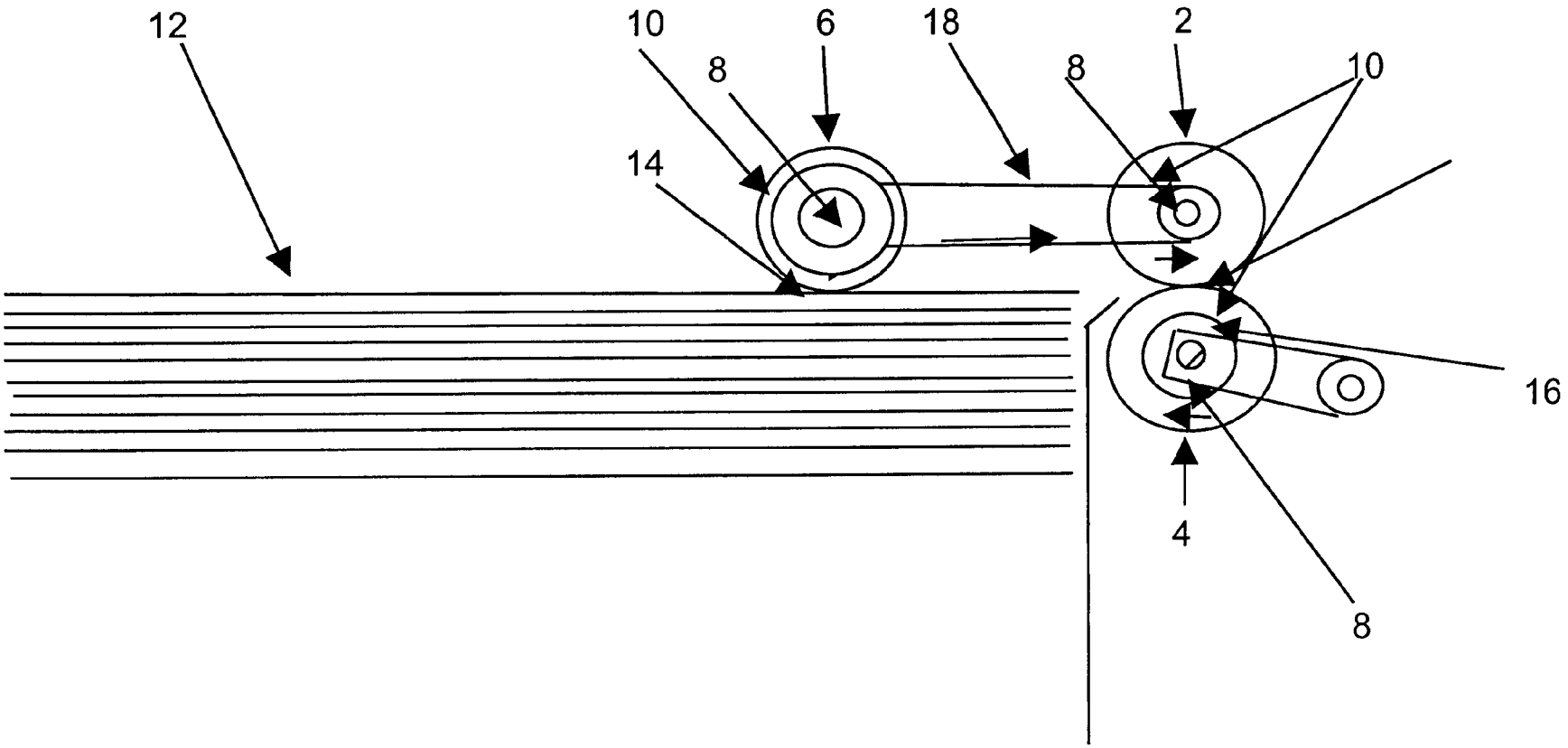
FIG. 1. is an illustration of a typical sheet feeding apparatus.

The invention is a sheet feeding apparatus comprising a feed roller 2 a retard roller 4, and a nudging roller 6, as seen in FIG. 1. More specifically, the invention is the use of a new outer material for the rollers involved in feeding paper into a reproduction apparatus. This new surface material gives the present feeding apparatus rollers a much longer lifetime than prior rollers. It also gives the rollers self-cleaning properties. In several tests that were conducted, the wear of the release layer was not measurable.

In the following paragraphs, I have used the term 'paper' generally for image receivers. It will be apparent to those with skill in the art that other materials are substitutable for actual paper if (1) they have COFs relative to each other and COFs relative to the feeding rollers that are close to that of paper's, or (2) the braking force and nip pressure are altered to maintain the same ratio between themselves and the COF. The latter option will be explained in more detail later.

It should also be understood that the word "copier" is used to mean any reproduction apparatus, be it copier, printer, facsimiles, scanners, etc.

It should also be understood that references to the COF of a material usually mean its "working" COF. When a roller is first manufactured its surface has a particular COF. This drops very quickly (within tens of sheets) to a working COF value. Unless otherwise noted, COF as used throughout the application, refers to the working COF.

It should further be understood that lifetime of the roller refers to its usable lifetime. When a roller becomes unusable depends upon a number of factors. These include how the roller wears (whether it wears evenly or not or how fast it wears), the tolerance of the device incorporating the roller to wear of the roller, whether the hardness of the roller changes with use, and how much the COF changes with use. Part of the appeal of the present rollers is their long usable lifetime.

The feed roller 2, the retard roller 4, and the nudging roller 6 are each comprised of a core (or shaft) 8 and an outer tire 10. The tire is a hollow cylindrical tube surrounding the core. It is usually premolded before being placed around the shaft. The tire fits snugly around the core. Unlike many prior art rollers, no adhesive or other gripping means are required to hold the tire to the core.

As can be seen in FIG. 1, the nudging roller 6 contacts the top sheet of a stack of sheets at 12 and pushes the top sheet into the nip 14 between the feed roller 2 and the retard roller 4. The retard roller 4 is connected to a clutch 16. A chain drive 18 causes the shaft 8 of the feed roller to rotate in cooperation with the nudging roller 6.

The rotation of the feed roller 2 causes the retard roller 4, whose surface contacts that of the feed roller, to rotate. The clutch 16 prevents the retard roller from rotating evenly with the feed roller. This is necessary to prevent misfeed situations. As will be discussed in more detail below, setting this braking force that the clutch applies properly is an integral part of this invention.

In the present invention, the tire for all three rollers is composed of a trade secret protected compound referred to as 35-28092-N-GY-A. This material is produced by Illbruck Office Products, 115 Canal Landing Boulevard, Rochester, N.Y. 14626. Nippon Zeen Co. Ltd., Furukawa-Sogo Bldg., 2-6-1 Marunouchi, Chiyoda-Ku, Tokyo, Japan also produces this material.

It works well due to its ability to deform without tearing or crumbling. It also degrades very slowly. No adhesive is necessary to hold the roller to the shaft. It should be understood that, even where not explicitly noted, the use of 35-28092-N-GY-A in a claim includes any substance that is chemically similar to or obvious from the makeup of 35-28092-N-GY-A.

The material works best generally if it has a hardness of between 20 and 45 JISA and a working COF greater than 1.6.

When the feed roller 2, retard roller 4, and nudging roller 6 are first installed in a copier, they have an initial COF of approximately 2.2–2.3. The COF rapidly drops after the first dozen or so copies down to a working COF of approximately 1.6, and then levels off. Many prior art rollers follow this same initial pattern of wear. However, after the initial drop in COF, they continue to lose COF, albeit at a slower rate. This is due both to continued wear and to an increase in the amount of contaminants that the roller picks up from the paper.

A feed roller or a retard roller that experiences a decrease in COF is more likely to misfeed. If the surface of the feed roller experiences a decrease in its COF, the rollers may fail to pull a sheet into the printer, resulting in a "nonfeed" situation. If the surface of the retard roller experiences a decrease in its COF, the rollers may pull two or more sheets into the printer, resulting in a "double feed" situation.

Figure 2:
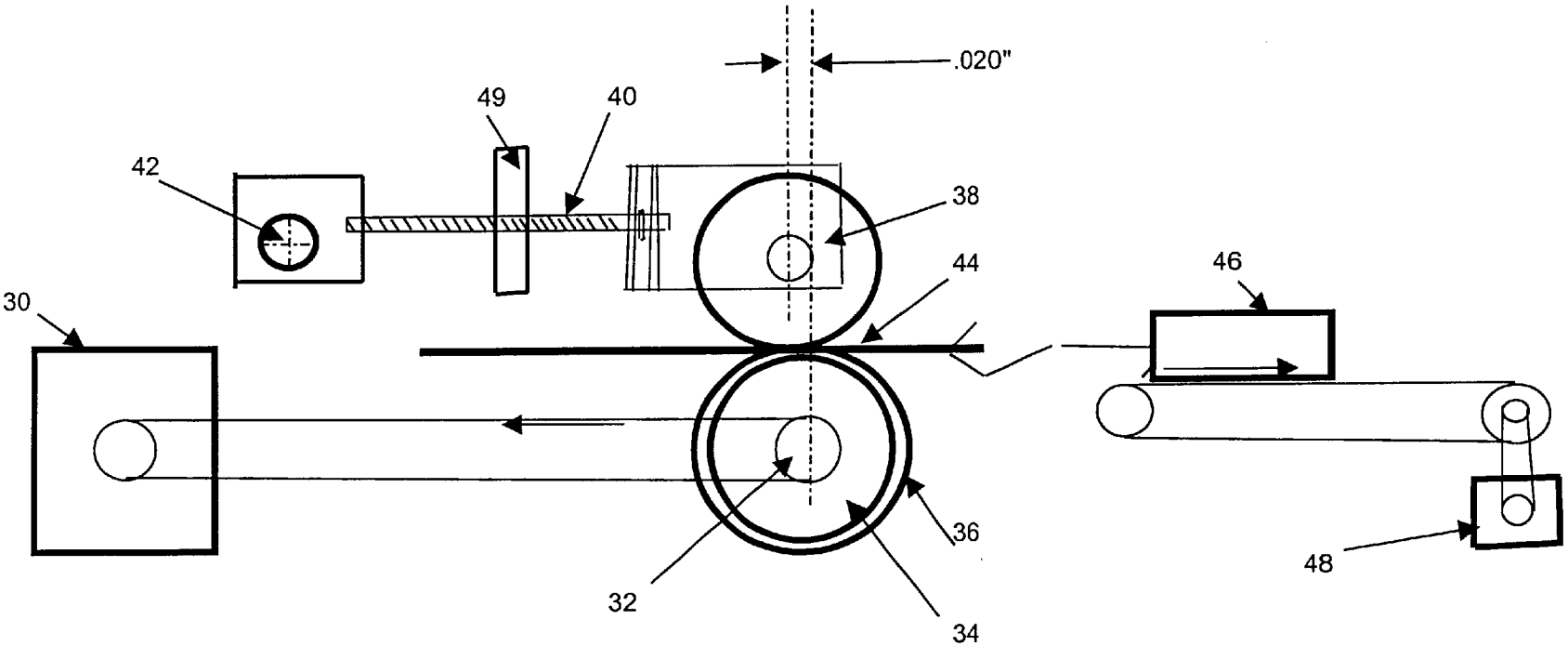
FIG. 2 of the COF testing apparatus.

The working COF was tested using the apparatus shown in FIG. 2. A motor 30 drives a rotating shaft 32. The shaft consists of a hub 34 with a tire 36 surrounding it. Resting on top of the shaft is a bearing wheel 38. The center of the bearing wheel is offset 0.02" horizontally from the center axis of the shaft 32. A rod 40 connects the bearing wheel to an axis 42. The rod 40 pivots about the axis 42. Between the bearing wheel and the pivot point is located an adjustable weight 49. This weight is used to control the amount of force that the bearing wheel exerts on the shaft, i.e., it controls the nip pressure between them.

A motor 48 pulls sheet of paper 44 through the nip between the bearing wheel and shaft. A scale 46 measures the force required to pull the paper through the nip. A COF for the tire is calculated from these force measurements. This measurement process is repeated 4000 times within one revolution of the tire 36, and the data bits are averaged and recorded along with the standard deviation.

35-28092-N-GY-A gives the rollers a renewing surface. Even after many thousands of feeds, the surface of the tire remains substantially free from contaminants. The rollers of the current invention last much longer than prior art rollers. This is part of what makes 35-28092-N-GY-A a superior surface layer for a roller.

The primary advantage to rollers made with 35-28092-N-GY-A is the very long life they have in some printers when operating under certain conditions. These rollers have been tested in the field on various black and white and color printers for Xerox. All these tests returned great results as long as the machines were operated within certain predefined parameters. They have worked for hundreds of thousands of copies and not been noticeably worn.

However, the standard wear testing procedures and durability tests for roller materials returned poor results. The major reason for this is that the standard testing methods fail to take into account the relationship between COF, nip pressure, and braking force involved in actual use. In response applicants developed a new testing procedure that better simulates actual wear. Many tests were conducted on an original measuring device developed by one of the Applicants.

Figure 3:
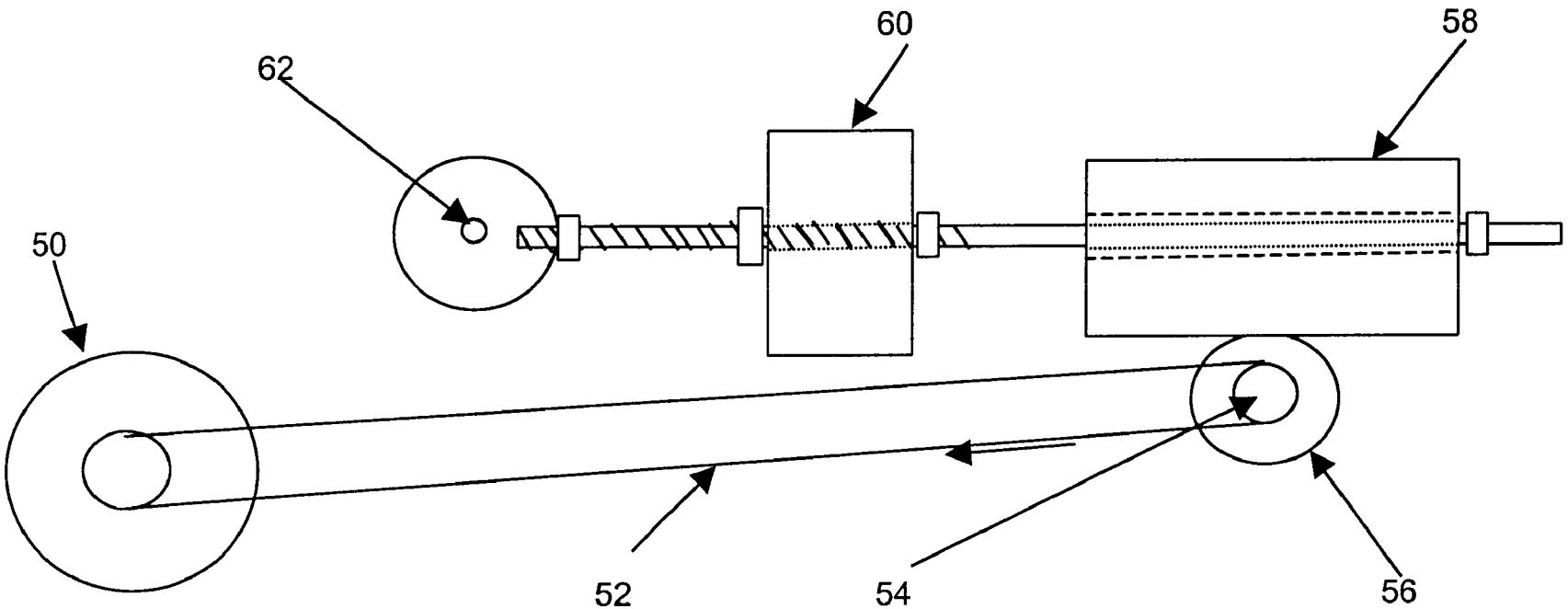
FIG. 3 is an illustration of the wear testing apparatus.

The wear testing apparatus is illustrated in FIG. 3. This test will be referred to hereinafter as the Illbruck wear test. A motor 50 drives a belt 52 that turns a shaft 54. The speed of rotation can be adjusted depending on the tire being tested. The tire 56 to be tested is placed around the shaft. A block of maple wood 58 can be moved into contact with the tire 56. The wood block 58 is connected to a pivotable arm. An adjustable weight 60 is secured between the pivot point 62 of the arm and the wood block 58. The position and mass of the adjustable weight 60 determine how much force the wood block places on the tire.

On this equipment it was determined that each hour of wear was equivalent to 12,500 paper feeds. The rollers made with the new material lasted longer than 144 hours, which is the equivalent of 1.8 million feeds. The shaft is rotated at a speed to cause 85 inches per minute of slip between the tire and the wood block with a nip pressure of ten ounces.

It was stated in the preceding paragraphs that these rollers are long lasting under certain conditions. These conditions are achieved by choosing the COF, the force between the two rollers, and the braking force on the retard roller, based on the interdependency between them.

These three elements are related by a formula. This is true in any case where the feed roller and the retard roller have the same surface material. Essentially, the COF, nip pressure, and braking force should be chosen so that they satisfy the following relationship:

$$(\mu - X)*NP = F_{BF};$$

where $\mu$ represents the COF of the rollers, NP represents the nip pressure between the two rollers and $F_{BF}$ represents the braking force on the surface of the retard roller. X is number ranging from 0.15 to 0.4. It is subtracted from the COF for the purpose of ensuring that the retard roller rotates. Setting X=0.2 yields the best results.

The term nip pressure has been used here and throughout this description, as synonymous with the normal force between the rollers. While it is true that force and pressure are not the same thing, this is the convention in the art.

While experimentation has not been done, it is strongly believed that use of 35-28092-N-GY-A in other types of copiers would work just as well. Some copier feeding mechanisms consist of a feed roller and a mat. The COF and nip pressure are set so that the feed roller only grabs one sheet at a time. It is believed that the use of 35-28092-N-GY-A for the outer layer of the roller will greatly increase the lifetime of these devices.

While the invention has been described in connection with preferred embodiments, it is not intended to limit the scope of the invention to the particular forms set forth, but on the contrary, it is intended to cover such alternatives, modifications, and equivalents as may be included within the spirit and scope of the invention as defined by the appended claims.

What is claimed is:

1. An apparatus for feeding sheets seriatim from a stack located on the surface of a tray, said apparatus comprising:

a) a feed roller comprising a first tire made of a material with a COF of 1.6 or greater;

b) a retard roller connected to a clutch or brake with a fixed rotation resistance, operatively coupled with the feed roller for forming a nip, the retard roller comprising a second tire made of a material with a COF of 1.6 or greater; and c) at least one of the first and second rollers loses between 2% and 10% of its mass after 1,000,000 feeds.

2. The apparatus of claim 1, where the retard roller is spring loaded against the feed roller.

3. The apparatus of claim 1, where the feed roller is spring loaded against the retard roller.

4. The apparatus of claim 1, where each of the first tire and the second tire lose between 2% and 10% of its mass after 1,000,000 feeds.

5. An apparatus for feeding sheets seriatim from a stack located on the surface of a tray, said apparatus us comprising:

a) a feed roller comprising a first tire made of a material with a COF of 1.6 or greater;

b) a retard roller connected to a clutch or brake with a fixed rotation resistance, operatively coupled with the feed roller for forming a nip, the retard roller comprising a second tire made of a material with a COF of 1.6 or greater; and c) at least one of the first and second tires loses between 2% and 10% of its mass after 144 hours of the Illbruck wear test.

6. The apparatus of claim 5, where each of the first tire and the second tire lose between 2% and 10% of its mass after 144 hours of the Illbruck wear test.

7. A method for increasing the useful lifetime of a sheet feeding apparatus having a first roller and a second roller forming a nip with a fixed pressure between them, where the second roller has a braking mechanism that applies a fixed braking force, and both rollers having substantially the same COF, comprising: choosing the COF, the nip pressure, and the braking force so that they satisfy the relationship: $(COF-X)^* NP=F_{BF}$, where X has a range extending from 0.15 to 0.4.

8. An apparatus for transporting sheets seriatim from a stack located on the surface of a tray, said apparatus comprising:

a feed roller comprising a first tire made of a material with a COF of 1.6 or greater; and (b) a retard roller with a fixed rotation resistance, operatively coupled with the feed roller for forming a nip, the retard roller comprising a second tire made of a material with a of 1.6 or greater, the COF, fixed rotation resistance ($F_{BF}$) and pressure at the Nip (NP) satisfy the relationship $(COF-X)^*NP=F_{BF}$, where X has a range extending from 0.15 to 0.4.

9. An apparatus for feeding sheets seratim from a stack located on the surface of a tray, said apparatus comprising:

a) feed and retard rollers operatively connected for forming a nip therebetween;

b) at least said feed roller comprising a tire having a COF of 1.6 or greater; and c) said feed tire loses between 2% and 10% of its mass after 1,000,000 feeds.

* * * * *

UNITED STATES PATENT AND TRADEMARK OFFICE

CERTIFICATE OF CORRECTION

PATENT NO. : 6,581,925 B1
DATED : June 24, 2003
INVENTOR(S) : Shea, Robert et al.

It is certified that error appears in the above-identified patent and that said Letters Patent is hereby corrected as shown below:

Title page, Item [54] and Column 1, lines 1-3,
"FEEDER AND RETARD ROLLERS, AND METHOD OF MAXIMIZING LIFETIME OF ROLLERS" should read -- NEW FEEDER AND RETARD ROLLERS, AND METHOD OF MAXIMIZING LIFETIME OF ROLLERS --.

Title page,
Item [75], Inventor, "Elji" should read -- Eiji --.

Column 5,
Line 44, delete "us".

Signed and Sealed this

Twenty-eighth Day of October, 2003

JAMES E. ROGAN
*Director of the United States Patent and Trademark Office*